US005344029A

United States Patent [19]

Oghia et al.

[11] Patent Number: 5,344,029

[45] Date of Patent: Sep. 6, 1994

[54] DISHWASHER HOLDDOWN RACK

[75] Inventors: Anne T. Oghia; Hady G. Oghia, both of 14 Cliffwood Pl., Metuchen, N.J. 08840

[73] Assignee: Ann T. Oghia, Metuchen, N.J.

[21] Appl. No.: 218,712

[22] Filed: Mar. 25, 1994

[51] Int. Cl.[5] ..... A47F 7/00

[52] U.S. Cl. ..... 211/41; 211/181; 211/198; 248/499

[58] Field of Search ..... 211/41, 181, 198, 195; 248/499; 220/485, 487, 488

[56] References Cited

U.S. PATENT DOCUMENTS

| | | | |
|---|---|---|---|
| 1,562,614 | 11/1925 | Blakeslee . | |
| 3,752,322 | 8/1973 | Fiocca et al. | 211/41 |
| 4,498,594 | 2/1985 | Elder | 211/181 X |
| 4,589,556 | 5/1986 | Peretz | 211/41 |
| 4,830,200 | 5/1989 | Zambano et al. | 211/181 |
| 5,114,019 | 5/1992 | Sandbank | 211/41 |
| 5,121,843 | 6/1992 | Elder | 211/41 |
| 5,201,826 | 4/1993 | Zimmermann | 211/41 |
| 5,205,419 | 4/1993 | Purtilo | 211/41 |
| 5,249,590 | 10/1993 | Jacobus et al. | 211/41 X |

*Primary Examiner*—Robert W. Gibson, Jr.
*Attorney, Agent, or Firm*—David L. Davis

[57] ABSTRACT

Rack-like structure adapted to be placed over items in the upper rack of a dishwasher to hold them down and prevent them from being inverted. The structure includes three pivotally connected sections which allow the structure to engage taller items in the center of the upper rack and shorter items along the outer edges of the upper rack. The outer sections include pockets along their outer edges for holding container lids and the like.

4 Claims, 2 Drawing Sheets

DISHWASHER HOLDDOWN RACK

BACKGROUND OF THE INVENTION

This invention relates to accessories for use with an automatic dishwasher and, more particularly, to rack-like structure adapted for placement over items situated in the upper rack of a dishwasher to prevent those items from being inverted by the force of the water during the wash cycle of the dishwasher.

An automatic dishwasher for home use typically has a lower rack and an upper rack. The lower rack is usually provided with upstanding posts which define regions for holding generally planar items, such as plates, on edge. The upper rack is usually provided with upstanding posts which define parallel front-to-back channels for holding glasses, cups, bowls, and other miscellaneous items not well suited for placement in the lower rack. In addition, plastic items are usually placed in the upper rack so as to be sufficiently spaced from the heating element located beneath the lower rack and which is energized during the drying cycle of the dishwasher so that they are not damaged by direct heat from the element.

Hollow items, such as glasses, cups and bowls, are placed upside down in the upper rack so that they do not fill with water during the wash cycle. However, the force of the water against these items, especially those that are lightweight, such as plastic cups, can often invert them to their upright positions so that they fill with water. When filled with water, these items are sufficiently heavy that they remain upright. This causes several well recognized problems. Thus, the water remaining in the items usually contains food debris, so the items have to be rewashed. Also, when the upper rack is pulled out or even merely nudged when dishes are removed from the lower rack, the items filled with water tend to tip over and the debris-laden water spills onto the otherwise clean dishes in the lower rack, requiring them to be rewashed as well. It is therefore a primary object of this invention to provide an arrangement for preventing items placed in the upper rack of a dishwasher from inverting during the wash cycle of the dishwasher.

U.S. Pat. Nos. 5,114,019 and 5,121,843 disclose nets which go over the items in the upper rack of a dishwasher to prevent them from being inverted. However, these nets must be secured to the upper rack to hold them in place, which can prove to be inconvenient and, for people with below average dexterity, difficult to effect. It is therefore another object of this invention to provide such an arrangement which is simple to use without requiring that it be secured to the upper rack of the dishwasher.

A problem frequently encountered with dishwashers is that there is no place in either the lower or upper rack for placing container lids. These lids are usually generally flat and are lightweight. Therefore, the force of the water during the wash cycle can move these lids and they can fall through the grid of the lower rack, making them difficult to retrieve. In addition, after falling beneath the lower rack, they can contact the heating element, resulting in damage to the lids. It is therefore a further object of this invention to provide an arrangement of the type described which includes means for holding container lids and the like.

SUMMARY OF THE INVENTION

The foregoing, and additional, objects are attained in accordance with the principles of this invention by providing rack-like structure adapted to overlie items placed in the upper rack of a dishwasher. The inventive structure comprises a plurality of planar panels each including a generally rectangular four-sided outer rail and a plurality of spaced parallel transverse rails each connected to an opposed pair of sides of the outer rail. The inventive structure further comprises means for pivotally connecting the panels in side-to-side relationship. In practice, the upper rack of the dishwasher is filled so that each of its front-to-back channels contains substantially equal height items. The inventive structure is then placed over those items, and the pivotal relationship between the panels allows the inventive structure to adapt to the varying item heights between channels.

In accordance with an aspect of this invention, at least one of the panels has connected thereto in parallel and spaced relation a generally planar and rectangular secondary rack member. The connection of the secondary rack member with the at least one panel forms an open pocket structure for holding container lids and the like generally parallel to the at least one panel.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
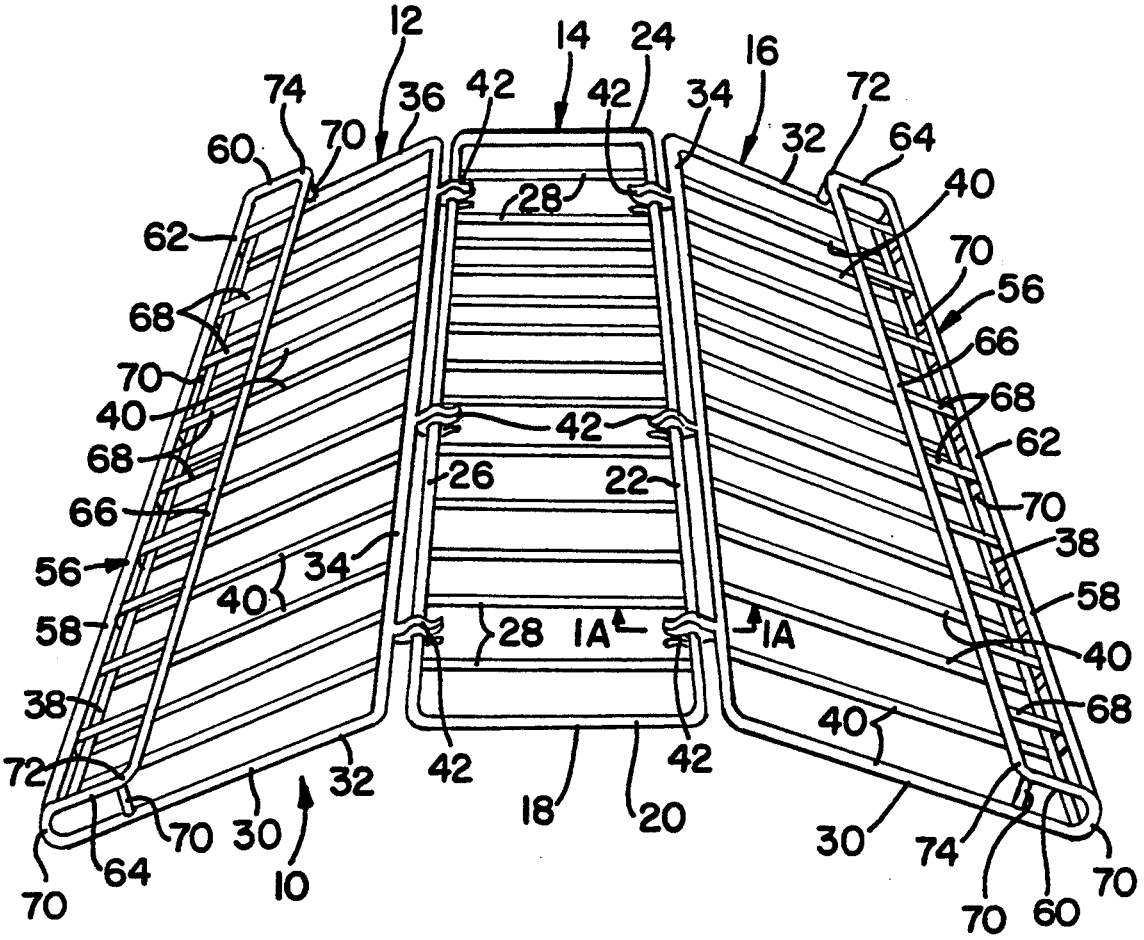
FIG. 1 is a perspective view of structure according to this invention.

As shown in FIG. 1, the inventive structure, designated generally by the reference numeral 10, includes a plurality of planar panels 12, 14 and 16, illustratively three in number, held together in side-to-side relationship, with the two outer panels 12 and 16 preferably being identical. The center panel 14 includes a generally rectangular outer rail 18 having four sides 20, 22, 24 and 26 and a plurality of parallel spaced transverse rails 28, each of which is connected to an opposed pair of sides 22, 26 of the outer rail 18. Similarly to the center panel 14, the panels 12 and 16 each includes a generally rectangular outer rail 30 having four sides 32, 34, 36 and 38 and a plurality of transverse rails 40, each of which is connected to an opposed pair 34, 38 of the sides of the outer rail 30.

The panels 12, 14 and 16 are connected in side-to-side relationship in such a manner that they may be pivoted relative to each other. To effect such pivotal connection, the sides 34 of the panels 12 and 16 have secured thereto at least two connecting members 42. As shown, there are three connecting members 42 secured to each of the sides 34. It is preferred that there be at least two connecting members 42 in spaced relation to each other. Although the connecting members 42 are shown as being secured to the side 34 of each of the panels 12 and 16, it is understood that, alternatively, the connecting members 42 may be secured to the sides 22 and 26 of the outer rail 18 of the panel 14. It is a matter of design choice as to which side of which panel the connecting members 42 are secured. Preferably, the connecting members 42 extend away from the panel to which they are secured generally in the plane of that panel.

Figure 1A:
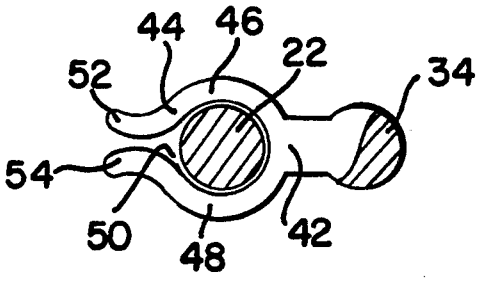
FIG. 1A is a side view, taken along the line 1A—1A in FIG. 1, showing illustrative structure for pivotally interconnecting the panels.

As shown in FIG. 1A, each connecting member 42 includes a bifurcated portion 44 having a pair of legs 46 and 48. The bifurcated portion 44 has a generally circular open region 50 between the legs 46 and 48 which is open away from the side 34. The distal ends 52 and 54 of the legs 46 and 48, respectively, diverge at their remote ends. This allows entry of the side 22 (or the side 26) between the legs 46 and 48 and into the open circular region 50 in a snap fit manner. Even if the side 22 is held relatively tightly by the connecting member 42, relative pivoting of the panels 14 and 16 may still be effected.

There is preferably further provided for connection to the outer panels 12 and 16 a generally planar secondary rack member 56. The secondary rack member 56 has a generally rectangular outer rail 58 having four sides 60, 62, 64 and 66, and a plurality of parallel spaced transverse rails 68 each connected to an opposed pair of sides 62, 66. The secondary rack member 56 is smaller in area than each of the panels 12 and 16. In particular, if the structure 10 includes more than two panels, the secondary rack member 56 is smaller in area than whichever of the panels is only connected on one of its sides to another of the panels (i.e., an outer panel). The secondary rack member 56 is connected to the panel 12 along three of its sides 60, 62 and 64 in spaced parallel relation to the panel 12 so as to form a pocket which is open toward the panel 14 along the fourth side 66 of the secondary rack member 56. Such connection is illustratively by means of the posts 70 secured to both the panel 12 and the secondary rack member 56. Depending on the manufacturing process, it may be preferable to form the secondary rack member 56 as an extension of the panel 12, and then bend it so that it overlies the panel 12 and secure it in that position with the posts 70 only at the corners 72 and 74. In this case, extensions of the sides 32 and 36 and the transverse rails 40 form the other posts 70, an extension of the side 32 forms the side 64, an extension of the side 36 forms the side 60, and extensions of the transverse rails 40 form the transverse rails 68.

Preferably, the entire structure 10 is formed from plastic coated metal rods to prevent marring of the items which it contacts in the dishwasher.

Figure 2:
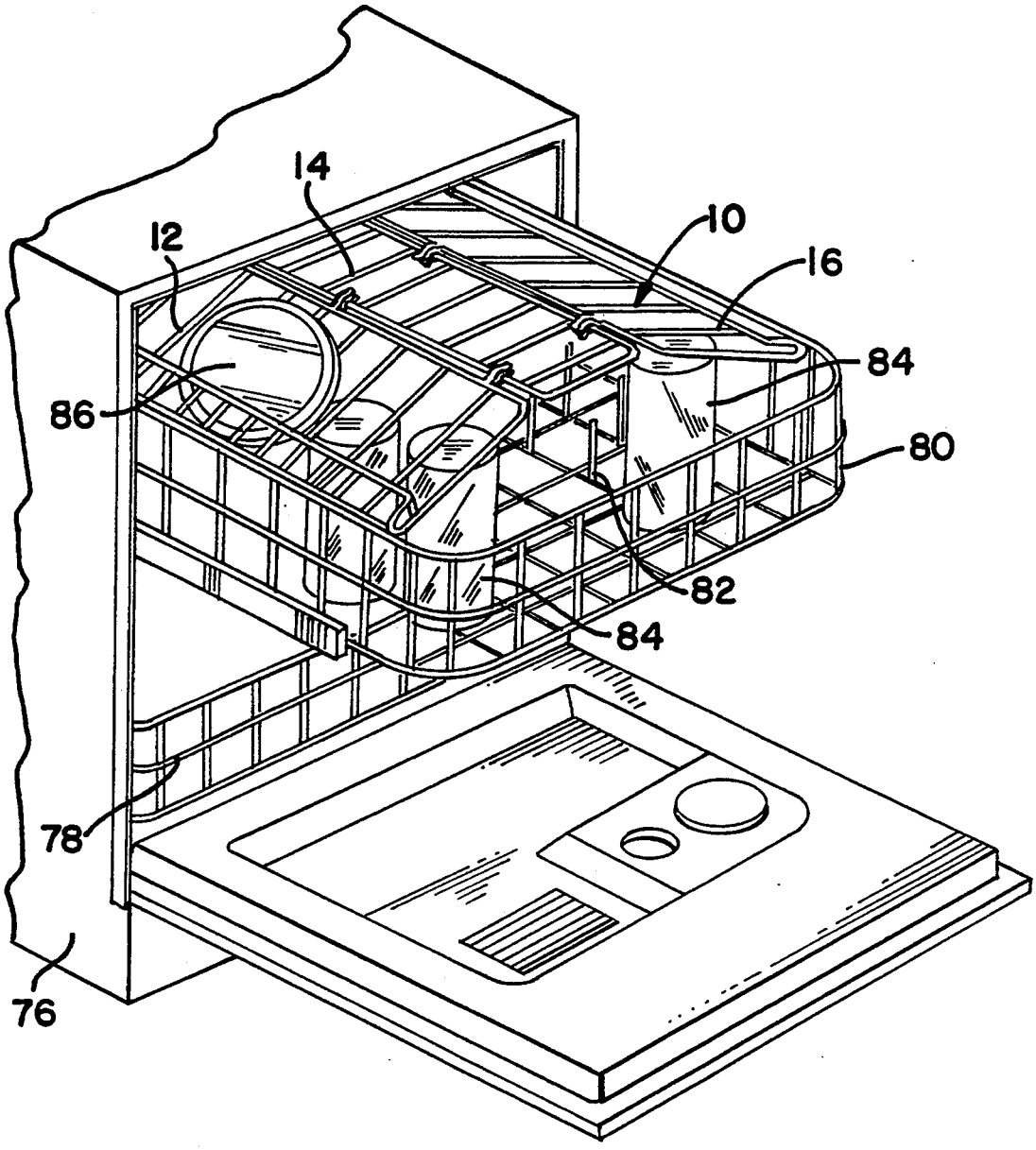
FIG. 2 is a perspective view of a dishwasher with the top rack pulled out and having structure according to this invention in place.

FIG. 2 illustrates the use of the structure 10 shown in FIG. 1. As is conventional, an automatic dishwasher 76 for home use includes a lower rack 78 and an upper rack 80. The present invention is concerned with the upper rack 80 which typically has a plurality of upstanding posts 82 arranged to form a plurality, generally five in number, of parallel front-to-back channels for holding glassware 84 and the like. When using the present invention, it is preferred that each of the front-to-back channels contain the same height items, with the taller items being in the center channel. After the items to be washed are disposed in the upper rack 80, the structure 10 is placed thereover. The size of the panels 12, 14 and 16 is such that the width of the structure 10 is substantially the same as, or slightly smaller than, the width of the upper rack 80. When the structure 10 is placed over the items in the upper rack 80, the pivoting connection of the panels 12, 14 and 16 allows the panels to engage the different height items. The weight of the structure 10 is sufficient to prevent those items which it contacts from being inverted by the force of the water during the wash cycle. If a container lid 86 is to be washed, it is placed above the panel 12 or 16 and moved outwardly so that it is captured between the secondary rack member 56 and the respective panel. The spacing between the secondary rack member 56 and the respective panel 12 or 16 should be about one inch to accommodate the lid 86.

Accordingly, there has been disclosed improved rack-like structure for preventing items in the upper rack of the dishwasher from being inverted by the force of the water during the wash cycle of the dishwasher. While an illustrative embodiment has been disclosed herein, it will be apparent to one of ordinary skill in the art that various modifications and adaptations to the disclosed embodiment can be made without departing from the spirit and scope of this invention, which is intended to be limited only by the appended claims.

What is claimed is:

1. Structure adapted to overlie items placed in the upper rack of a dishwasher comprising:

a plurality of planar panels each including a generally rectangular outer rail having four sides and a plurality of parallel spaced transverse rails each connected to an opposed pair of sides of said outer rail; and means for pivotally connecting said panels in side-to-side relationship.

2. The structure according to claim 1 further comprising:

a generally planar secondary rack member including a generally rectangular outer rail having four sides and a plurality of parallel spaced transverse rails each connected to an opposed pair of sides of the outer rail of said secondary rack member, said secondary rack member being smaller in area than one of said panels which is only connected on one of its sides to another of said panels; and means for connecting said secondary rack member to said one panel along three sides of said secondary rack member in spaced parallel relation to said one panel so as to form a pocket open toward said another panel along the fourth side of said secondary rack member for holding container lids and the like generally parallel to said one panel.

3. The structure according to claim 1 wherein said outer and transverse rails are formed from plastic coated metal rods.

4. The structure according to claim 1 wherein the means for pivotally connecting said panels comprises at least two connecting members secured to one of the sides of the outer rail of one of said panels in spaced relation to each other, each of said connecting members extending away from said one panel generally in the plane of said one panel and including a bifurcated portion open away from said one side, said bifurcated portion having a generally circular open region adapted to be snap fit over a side of the outer rail of another of said panels.

* * * * *